US007500670B2

(12) United States Patent
Kitazawa

(10) Patent No.: US 7,500,670 B2
(45) Date of Patent: Mar. 10, 2009

(54) SHEET CONVEYING DEVICE AND IMAGE FORMING APPARATUS

(75) Inventor: Osamu Kitazawa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 524 days.

(21) Appl. No.: 11/179,479

(22) Filed: Jul. 13, 2005

(65) Prior Publication Data

US 2006/0012112 A1 Jan. 19, 2006

(30) Foreign Application Priority Data

Jul. 15, 2004 (JP) ..... 2004-209005

(51) Int. Cl.
*B65H 5/02* (2006.01)

(52) U.S. Cl. ..... 271/274; 271/272

(58) Field of Classification Search ..... 271/274, 271/272

See application file for complete search history.

(56) References Cited

U.S. PATENT DOCUMENTS

| | | | | | |
|---|---|---|---|---|---|
| 4,605,218 | A * | 8/1986 | Knepper et al. | ..... | 271/238 |
| 4,607,837 | A * | 8/1986 | Pierce | ..... | 271/273 |
| 4,627,607 | A * | 12/1986 | Ishii | ..... | 271/122 |
| 5,344,058 | A * | 9/1994 | Baffo | ..... | 226/181 |
| 5,600,426 | A * | 2/1997 | Gramlich et al. | ..... | 399/381 |
| 5,762,332 | A * | 6/1998 | Haroutel et al. | ..... | 271/274 |
| 6,164,641 | A * | 12/2000 | Harada et al. | ..... | 271/198 |
| 6,672,579 | B2 * | 1/2004 | Araki et al. | ..... | 271/122 |
| 6,681,096 | B2 * | 1/2004 | Seto et al. | ..... | 399/388 |
| 6,870,561 | B2 * | 3/2005 | Yamada | ..... | 347/262 |
| 7,080,836 | B2 * | 7/2006 | Hamada et al. | ..... | 271/274 |
| 7,176,955 | B2 * | 2/2007 | Tanabe | ..... | 347/215 |
| 7,252,287 | B2 * | 8/2007 | Tsutoh | ..... | 271/274 |
| 2005/0040583 | A1 * | 2/2005 | Murakami et al. | ..... | 271/65 |

FOREIGN PATENT DOCUMENTS

| | | | |
|---|---|---|---|
| CN | 1087838 | C | 7/2002 |
| JP | 9-156799 | A | 6/1997 |
| JP | 2002-356242 | A | 12/2002 |

OTHER PUBLICATIONS

Webster's New Basic Dictionary, copyright 2007, 2005 by Houghton Mifflin Company, p. 681.*

* cited by examiner

*Primary Examiner*—Patrick H Mackey
*Assistant Examiner*—Prasad V Gokhale
(74) *Attorney, Agent, or Firm*—Foley & Lardner LLP

(57) ABSTRACT

A spring is bridged between a pair of press levers, and a pair of driven rollers is pressurized uniformly, so that clamping and conveying force of the sheet of paper P on the front side and rear side by conveying rollers and the driven rollers is made equal such as Pf=Pr, the sheet of paper P are prevented from being skewed, while the sheet of paper P are clamped and conveyed by a conveying device, and the good conveying of the sheet of paper P is improved, thus the image quality is improved.

14 Claims, 5 Drawing Sheets

SHEET CONVEYING DEVICE AND IMAGE FORMING APPARATUS

CROSS REFERENCE TO RELATED APPLICATION

This application is based upon and claims the benefit of priority from prior Japanese Patent Application No. 2004-209005 filed on Jul. 15, 2004, the entire contents of which are incorporated herein by reference.

FIELD OF THE INVENTION

The present invention relates to a sheet-conveying device for conveying sheet such as paper and film and an image forming apparatus.

DESCRIPTION OF THE BACKGROUND

In an image forming apparatus such as an electrophotographic copier, a facsimile, and a printer, there is a sheet-conveying device, when supplying sheet such as sheet of paper and sheet-like films from a paper supply cassette device or a paper supply tray, for clamping the sheet by a separation sheet and a conveying roller or a separation roller and a conveying roller and supplying only the top of sheet. Further, there is a sheet-conveying device for clamping the sheet supplied and separated from the paper supply cassette device or paper supply tray by the conveying roller and a driven roller and conveying them in a predetermined direction. In such a sheet-conveying device, to stably convey sheet, in Japanese Patent Application 2002-356242, to pressurize a roller pair symmetrical left and right composed of a conveying roller and a driven roller, a constitution of pressuring the left and right shafts of the driven roller separately from each other using two springs is disclosed.

However, like the conventional device, when the driven roller is pressurized to the conveying roller using the left and right separate pressing means, the pressure of the driven roller to the conveying roller becomes imbalance due to variations in the left and right pressing means and the clamping and conveying force by the left and right conveying roller and driven roller pair becomes imbalance. Therefore, during conveyance, sheet 1s skewed, and conveying defects such as jamming and bending of front ends are caused, or the sheet must be greatly repositioned by an aligning roller. And when the repositioning by the aligning roller is not sufficient, a problem arises that the image quality is decreased due to image displacement. The same may be said with the conveying roller for separating and conveying only the top sheet.

Therefore, a sheet-conveying device and an image forming apparatus for causing no skewing when clamping and conveying sheet by the conveying roller and driven roller or the conveying roller and separating member, preventing conveying defects, repositioning surely the front ends of sheet at the position of the aligning roller, thereby obtaining good images are desired.

SUMMARY OF THE INVENTION

Accordingly, an advantage of the present invention is to provide a sheet-conveying device and an image forming apparatus for preventing skewing when clamping and conveying sheet, repositioning surely the front ends of the sheet by the aligning means, and causing no jamming and image displacement.

To achieve the above advantage, one aspect of the present invention is to provide a sheet-conveying device comprising a fixing roller member having a fixed shaft, a load roller clamping sheet together with said fixing roller member, a pair of first and second pressure units to press between said fixing roller member and said load roller member, by applies load to said fixing roller member, and a elastic member bridged between said pair of pressure units to elastic uniformly said pair of pressure units.

BRIEF DESCRIPTION OF THE DRAWINGS

FIG. 6-1 is a schematic perspective view showing the separation and conveying device of the second embodiment of the present invention, FIG. 6-2 is a schematic arrangement diagram showing the separation and conveying device of the second embodiment of the present invention.

DETAILED DESCRIPTION OF THE INVENTION

Figure 1:
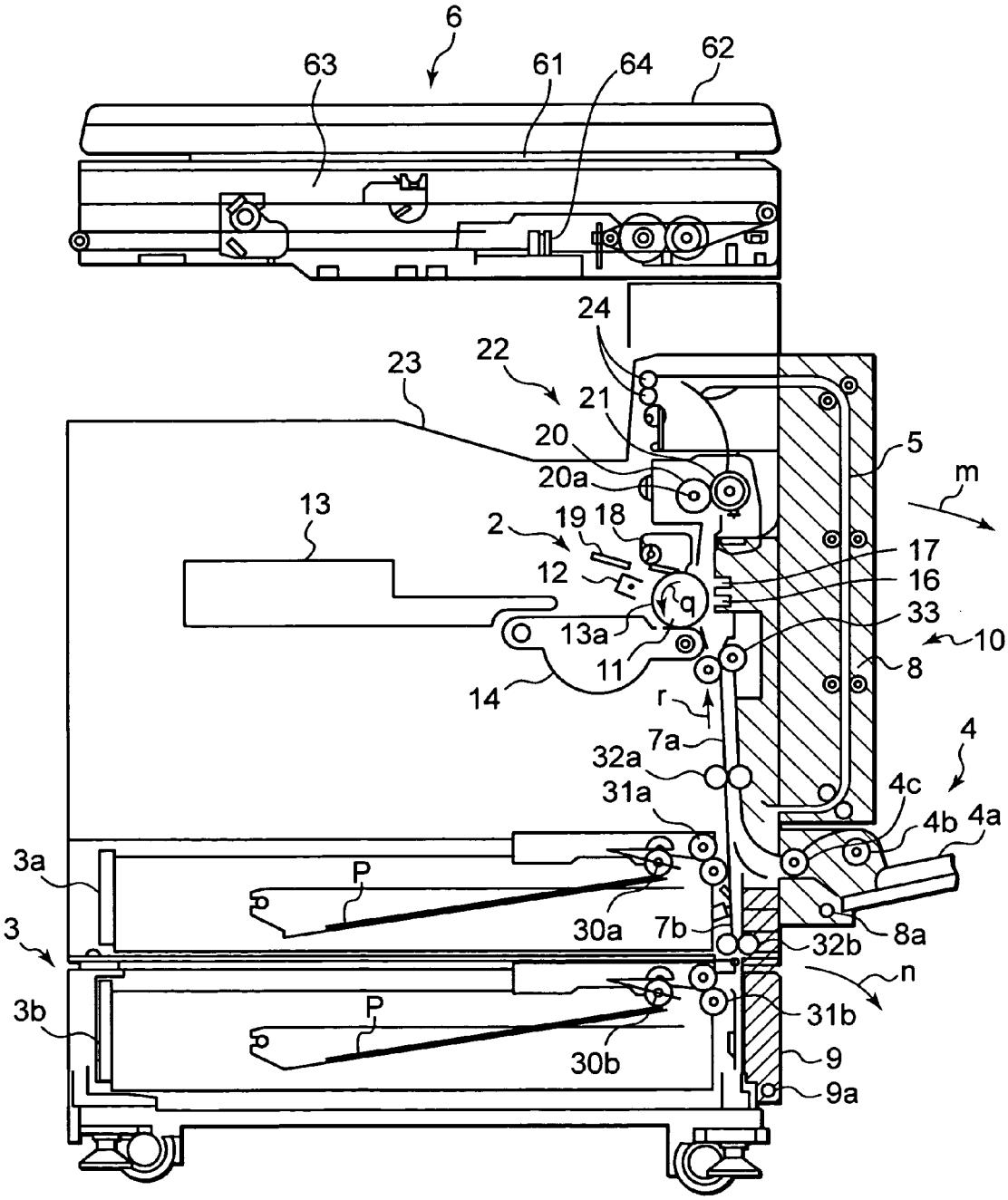
FIG. 1 is a schematic block diagram showing the copier of the first embodiment of the present invention.

Hereinafter, the first embodiment of the present invention will be explained in detail with reference to the accompanying drawings. FIG. 1 is a schematic block diagram showing a copier 10, which is an image forming apparatus using the sheet-conveying device, which is an embodiment of the present invention. The copier 10 has a cassette mechanism 3, which is a paper supply unit having paper supply cassettes 3*a* and 3*b* for storing sheet of paper P, which are sheet supplied toward an image forming unit 2, which is an image forming portion. Further, the copier 10 has a manual paper supply mechanism 4 having a manual separation and conveying device 4*c* for taking out sheet of paper P from a paper supply tray 4*a*, which is a paper supply unit by a manual pickup roller 4*b* and then separating and conveying the top of sheet of paper P. Further, the copier 10 has a reversing conveying path 5 for reversing sheet of paper P during double-side image forming. On the top of the copier 10, a scanner 6 for reading a document image is mounted.

The scanner 6 has a platen glass 61, a platen 62 for covering the platen glass 61, an optical unit 63 for irradiating light onto a document and focusing reflected light from the document, and a CCD scanner unit 64 for reading light from the optical unit 63.

The image forming unit 2, around a photosensitive drum 11, which is an image carrier, has a main charger 12 for uniformly charging the photosensitive drum 11, an exposure position 13*a* of a laser exposure device 13 for forming a latent image on the charged photosensitive drum 11 on the basis of image data from the scanner 6, a developing unit 14, a transfer charger 16, which is a transfer unit, a separation charger 17, a cleaner unit 18, and a discharging LED 19 according to the rotation of the photosensitive drum 11 in the direction of the arrow q.

On the downstream side of the image forming unit 2 in the direction of sheet of paper P, a fixing device 22, which is a fixing unit for clamping and conveying the sheet of paper P by a heat roller 20 having a built-in heater lamp 20*a* and a press roller 21 and heating, pressurizing, and fixing a toner image is mounted. On the downstream side of the fixing device 22, a paper ejection roller 24 for ejecting the sheet of paper P after fixing to a paper ejection tray 23 is mounted.

On supply conveying paths 7*a* and 7*b* from the paper supply cassettes 3*a* and 3*b* to the transfer charger 16, pickup rollers 30*a* and 30*b* for taking out sheet of paper P, first and second separation-conveying devices 31*a* and 31*b*, which are sheet-conveying devices, first and second conveying devices 32*a* and 32*b*, which are sheet-conveying devices, and furthermore an aligning roller 33, which is an aligning means are mounted. The supply conveying path 7*a* neighboring the image forming unit 2 has a first conveying path cover 8 indicated by hatching and the supply conveying path 7*b* neighboring the cassette mechanism 3 has a second conveying path cover 9 indicated by hatching. The first conveying path cover 8 rotates in the direction of the arrow m around a fulcrum 8*a*, thus the supply conveying path 7*a* can be opened. The second conveying path cover 9 rotates in the direction of the arrow n around a fulcrum 9*a*, thus the supply conveying path 7*b* can be opened.

Figure 2:
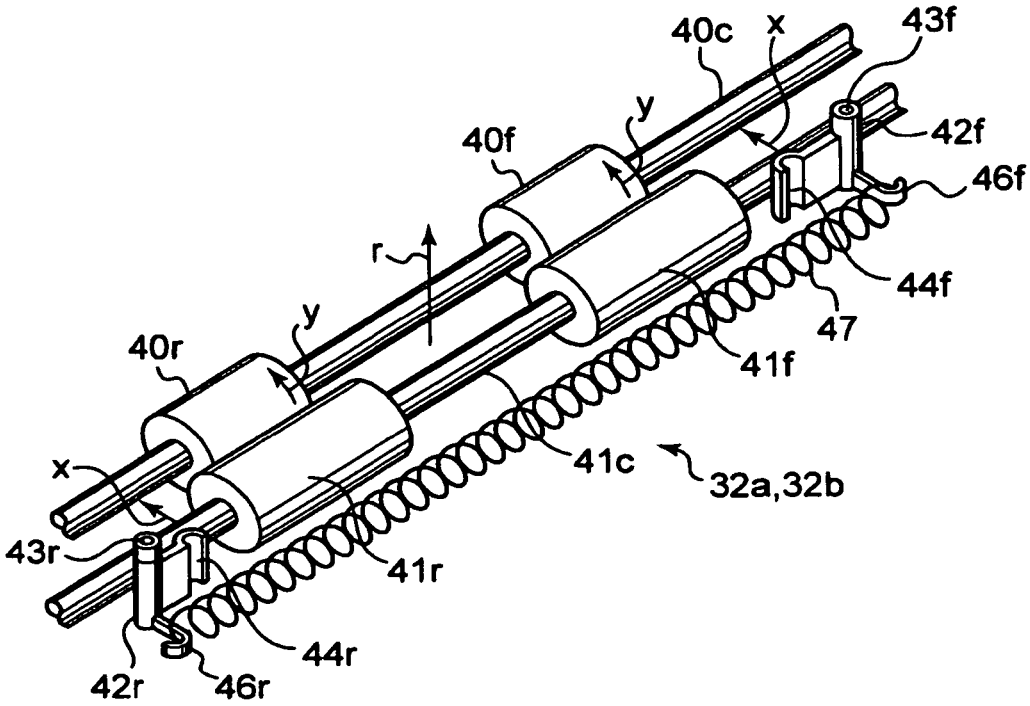
FIG. 2 is a schematic perspective view showing the conveying device of the first embodiment of the present invention.
Figure 3:
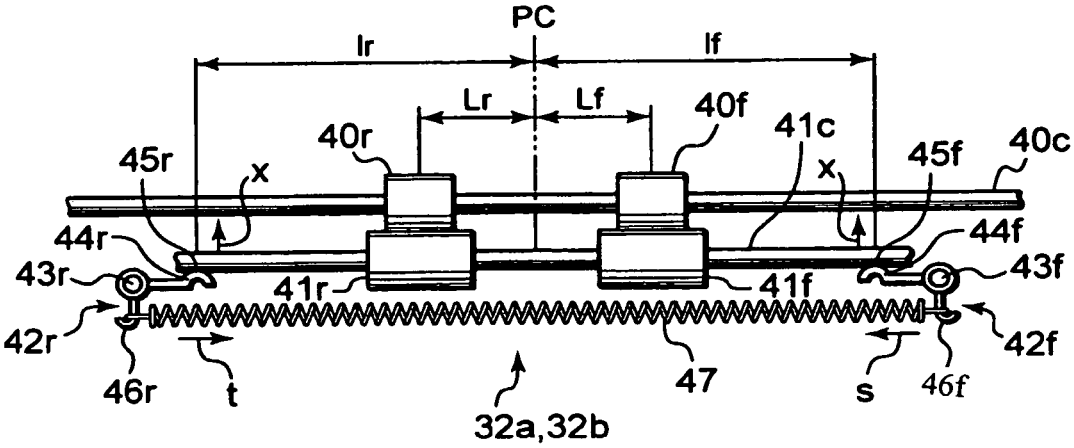
FIG. 3 is a schematic arrangement diagram showing the conveying device of the first embodiment of the present invention.

Next, the first and second conveying devices 32*a* and 32*b* will be described in detail. Further, the first and second conveying devices 32*a* and 32*b* have the same structure, so that one of them will be explained. For example, the first conveying device 32*a*, as shown in FIGS. 2 and 3, has a pair of conveying rollers 40*f* and 40*r*, which is a fixing roller member on the front side and rear side of a conveying roller shaft 40*c*, which is a fixed shaft linked with a drive motor (not drawn). At the opposite positions to the pair Of conveying rollers 40*f* and 40*r*, a pair of driven rollers 41*f* and 41*r*, which is a load roller member is mounted on the front side and rear side. The pair of conveying rollers 40*f* and 40*r*, for example, is made of synthetic rubber and the pair of driven rollers 41*f* and 41*r*, for example, is made of metal or resin. By the pair of conveying rollers 40*f* and 40*r* and the pair of driven rollers 41*f* and 41*r*, sheet of paper P are clamped and conveyed.

Figure 4:
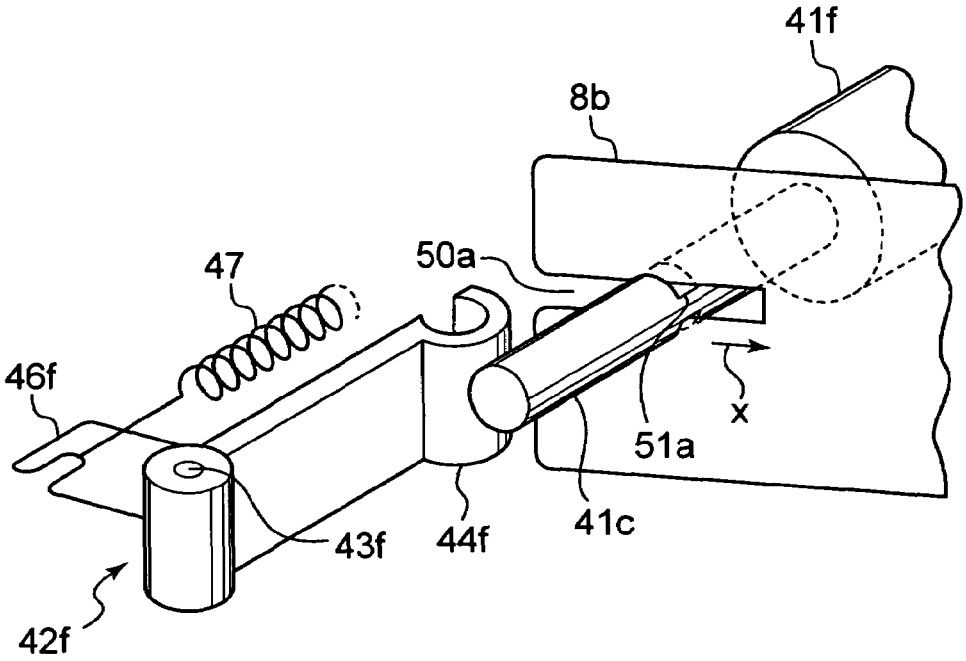
FIG. 4 is a schematic block diagram showing to be supported condition of the driven roller shaft on the front side of the first embodiment of the present invention.

The pair of driven rollers 41*f* and 41*r* is attached free rotation at a driven roller shaft 41*c*, which is a load shaft. As shown in FIG. 4, for example, on the front side, the driven roller shaft 41*c* is supported by a slit 50*a* formed in a frame 8*b* in the first conveying path cover 8 and can slide in the slit 50*a*. At both ends of the driven roller shaft 41*c*, a guide 51*a* is formed. The guide 51*a* is inserted through the slit 50*a*, thus the rotation of the driven roller shaft 41*c* is fixed. By doing this, the pair of driven rollers 41*f* and 41*r* can be driven to rotate stably by the pair of conveyer rollers 40*f* and 40*r*.

In the positions at the same distance from the centers of the driven rollers 41*f* and 41*r* on the front side and rear side, a pair of press levers 42*f* and 42*r* in an L shape, which is a pair of first and second pressure units in the same shape on the front side and rear side, is arranged respectively. The pair of press levers 42*f* and 42*r* is arranged possible rotation respectively around fulcrums 43*f* and 43*r*. An L-shaped free end 44*f* of the pair of press levers 42*f* and 42*r* on the front side makes contact and applies load with the driven roller shaft 41*c* at a pressure unit 45*f* on the front side, and a free end 44*r* on the rear side makes contact and applies load with the driven roller shaft 41*c* at a pressure unit 45*r* on the rear side, and the two free ends press the driven roller shaft 41*c* in the direction of the arrow x, which is the direction toward the pair of conveying rollers 40*f* and 40*r*.

At hooks 46*f* and 46*r* formed on the pair of press levers 42*f* and 42*r*, one spring 47, which is an elastic member is bridged. The spring 47 stretches the hook 46*f* on the front side in the direction of the arrow s and the hook 46*r* on the rear side in the direction of the arrow t with the uniform force and gives the uniform press to the free ends 44*f* and 44*f* of the pair of press levers 42*f* and 42*r* in the direction of the arrow x.

Here, to convey the sheet of paper P in the direction of in parallel with the arrow r, which is the conveying direction by the first conveying device 32*a*, the conveying force by the pair of conveying rollers 40*f* and 40*r* and the pair of driven rollers 41*f* and 41*r* on the front side and rear side must be equal. To make the conveying force by the pair of conveying rollers 40*f* and 40*r* and the pair of driven rollers 41*f* and 41*r* on the front side and rear side equal, pressure F on the pair of conveying rollers 40*f* and 40*r* by the pair of driven rollers 41*f* and 41*r* on the front side and rear side must be equal.

Figure 5:
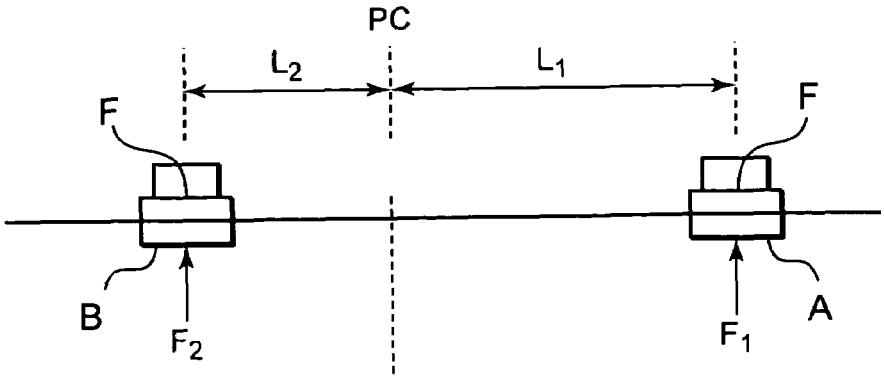
FIG. 5 is an illustration showing the principle of making the pressure of the driven roller to the conveying roller uniform on the front side and rear side of the first embodiment of the present invention.

Namely, for example, as shown in FIG. 5, on the basis of the center of the sheet of paper P in the conveying direction (hereinafter, abbreviated to PC), assumed the distance up to the center of a first fixing roller member A, which is the first position as $L_1$, the distance up to the center of a second fixing roller member B, which is the second position on the basis of the PC as $L_2$, the pressure applied between the first fixing roller member A and the load roller member C by the first pressure unit at center of the first fixing roller member A as $F_1$, and the pressure applied between the second fixing roller member B and the load roller member D by the second pressure unit at center of the second fixing roller member B as $F_2$, a formula of $F=F_1L_1=F_2L_2$ must be held.

Therefore, in this embodiment as shown in FIG. 3, on the basis of the PC, the pair of conveying rollers 40*f* and 40*r* and the pair of driven rollers 41*f* and 41*r* on the front side and rear side are laid out at the same distance toward the front and rear of the copier 10. Further, the pair of press levers 42*f* and 42*r* on the front side and rear side are laid out at the same distance toward the front and rear of the copier 10.

Namely, assumed the distance up to the center of the conveying roller 40*f* and the driven roller 41*f* from the PC on the front side as Lf, and the distance up to the center of the conveying roller 40*r* and the driven roller 41*r* from the PC on the rear side as Lr, a formula of Lf=Lr is held. Further, assumed the distance up to the free end 44*f* from the PC on the front side as lf, and the distance up to the free end 44*r* from the PC on the rear side as lr, a formula of lf=lr is held. Furthermore, the pair of press levers 42*f* and 42*r* on the front side and rear side is attracted uniformly by one spring 47 and the force pressurizing the driven roller shaft 41*c* by the press levers 42*f* and 42*r* is equal on the rear side and front side.

And, the distance from the center of the driven roller 41*f* on the front side to the press lever 42*f* on the front side and the distance from the center of the driven roller 41*r* on the rear side to the press lever 42*r* on the rear side are equal, so that the pressure on the front side and the rear side on the pair of conveying rollers 40*f* and 40*r* by the pair of driven rollers 41*f* and 41*r* by the pair of press levers 42*f* and 42*r* are equal. Namely, on the basis of the PC, the clamping and conveying force Pf of the sheet of paper P between the conveying roller 40*f* and the driven roller 41*f* on the front side and the clamping and conveying force Pr of the sheet of paper P between the conveying roller 40*r* and the driven roller 41*r* on the rear side are the same, that is, Pf=Pr.

Next, the operation of the present invention will be described. When the image forming process starts, the scanner 6 reads a document. In the image forming unit 2, the photosensitive drum 11 rotates in the direction of the arrow q, thereby is uniformly charged by the main charger 12, then is irradiated with a laser beam according to the document image by the laser exposure device 13, and forms an electrostatic latent image. Next, the developing unit 14 develops the electrostatic latent image and a toner image is formed on the photosensitive drum 11.

On the other hand, in the cassette mechanism 3 or the manual paper supply mechanism 4, by the pickup rollers 30*a* and 30*d* or the manual pickup roller 4*b*, predetermined sheet of paper P are picked up. Then, while the picked-up sheet of paper P pass the separation-conveying devices 31*a* and 31*b* or the manual separation-conveying device 4*c*, only the top of sheet of paper is separated and is fed toward the first or second conveying device 32*a* or 32*b*.

Then, the sheet of paper P separated by the first or second separation-conveying device 31*a* or 31*b* one by one reaches the first or second conveying device 32*a* or 32*b* and is clamped and conveyed in the direction of the arrow r, which is the direction toward the aligning roller 33. In the first or second conveying device 32*a* or 32*b*, the pair of conveying rollers 40*f* and 40*r* are rotated in the direction of the arrow y, which is a conveying direction of the sheet of paper P by driving by the conveying roller shaft 40*c* by the drive motor and the pair of driven rollers 41*f* and 41*r* making contact with the pair of conveying rollers 40*f* and 40*r* under pressure are driven to rotate and clamp and convey the sheet of paper P.

At this time, the pair of conveying rollers 40*f* and 40*r* and the driven rollers 41*f* and 41*r* are arranged symmetrically on the basis of the PC and the pair of press levers 42*f* and 42*r* are arranged symmetrically on the basis of the PC. So that, contact area of conveying rollers 40*f* and 40*r* and driven rollers 41*f* and 41*r* are arranged symmetrically on the basis of the PC. Furthermore, by the common spring 47, the pair of press levers 42*f* and 42*r* is given uniform tensile strength. Therefore, the clamping and conveying force Pf of the sheet of paper P by the conveying roller 40*f* and the driven roller 41*f* on the front side and the clamping and conveying force Pr of the sheet of paper P by the conveying roller 40*r* and the driven roller 41*r* on the rear side are the same, so that the sheet of paper P are not skewed, are kept straight, and reach the aligning roller 33.

As mentioned above, during conveyance by the first or second conveying device 32*a* or 32*b*, the sheet of paper P are not skewed, so that generally, the sheet of paper P are skewed little, and the dependence on repositioning of the sheet of paper P at the position of the aligning roller 33 is reduced, thus the aligning roller 33 can reposition the front ends of the sheet of paper P easily and surely.

After repositioning by the aligning roller 33, the sheet of paper P is conveyed to the position of the transfer charger 16 in synchronization with a toner image on the photosensitive drum 11 and after transfer of the toner image, is separated from the photosensitive drum 11 by the separation charger 17. After separation of the sheet of paper P, the photosensitive drum 11 is cleaned residual toner by the cleaner unit 18, is removed the residual charge by the discharging LED 19, and waits for the next image forming process. The sheet of paper P separated from the photosensitive drum 11 and having an unfixed toner image is inserted through the heat roller 20 and the press roller 21 of the fixing device 22 and after the toner image is heated, pressurized, and fixed, is ejected to the paper ejection tray 23.

In this embodiment structured like this, in the first or second conveying device 32*a* or 32*b*, on the basis of the PC, Lf=Lr and lf=lr and the tensile strength of the spring 47 bridged between the press levers 42*f* and 42*r* is the same. From this, the clamping and conveying force Pf of sheet of paper P by the conveying roller 40*f* and the driven roller 41*f* on the front side and the clamping and conveying force Pr of sheet of paper P by the conveying roller 40*r* and the driven roller 41*r* on the rear side are the same, that is, Pf=Pr.

Therefore, the sheet of paper P clamped and conveyed by the first or second conveying device 32*a* or 32*b* is not skewed by the first or second conveying device 32*a* or 32*b* and the good conveying can be improved. Further, the dependence on repositioning skewing of the sheet of paper P by the aligning roller 33 can be reduced, and the sheet of paper P can be repositioned surely before image forming, thus an image forming apparatus free of image displacement and of high image quality is obtained.

Figures 1, 6:
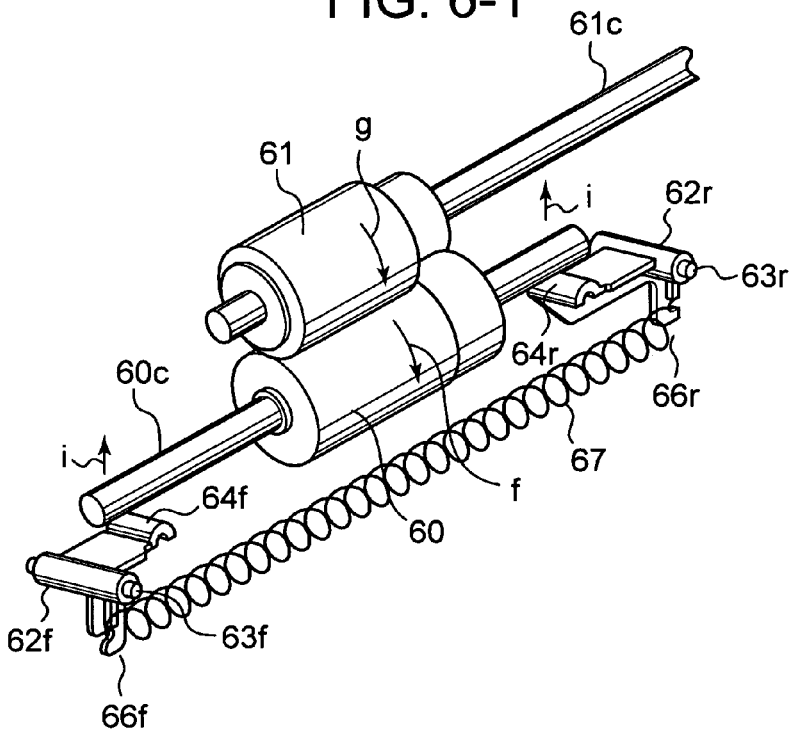
Figures 2, 6:
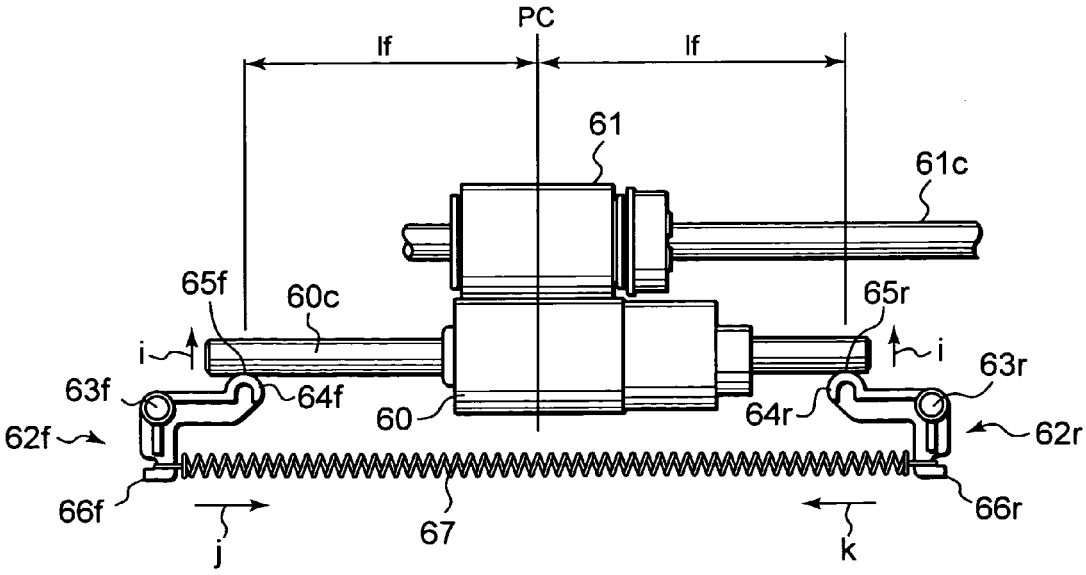

Next, the second embodiment of the present invention will be explained. The second embodiment is different in the constitution of the separation-conveying device from the first embodiment. Therefore, in the second embodiment, the same numerals are assigned to the same parts as those of the constitution explained in the first embodiment and the detailed explanation will be omitted. The first and second separation-conveying devices 31*a* and 31*b* of this embodiment have the same structure, so that one of them will be explained. As shown in FIG. 6-1 and FIG. 6-2, the separation device has a separation roller 60, which is a load roller member on a separation roller shaft 60*c*, which is a load shaft. The separation roller 60 is rotated in the direction of the arrow f, which is a separating direction of the sheet of paper P by prescribed driving force when the sheets of paper P are separated, to return the sheets of paper P picked up from the paper supply cassettes 3*a* or 3*b* by the pickup rollers 30*a* or 30*b* toward the paper supply cassettes 3*a* or 3*b*.

Figure 7:
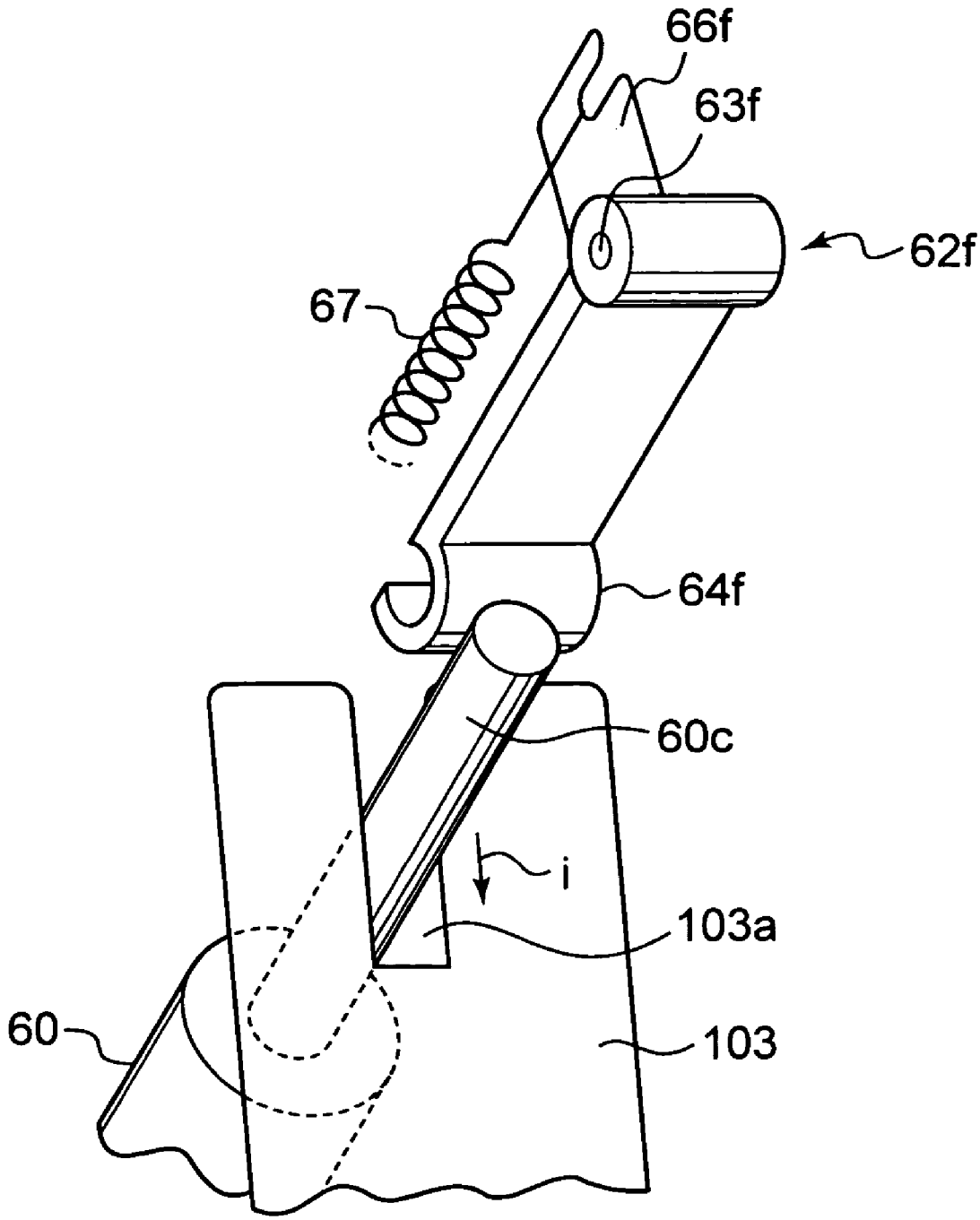
FIG. 7 is a schematic block diagram showing the support condition of the driven roller shaft on the front side of the second embodiment of the present invention

At the opposite positions to the separation roller 60, a paper supply roller 61, which is a fixing roller member is mounted. The paper supply roller 61 is rotated by a paper supply motor (not drawn) in the direction of the arrow g, which is a conveying direction of the sheet of paper P and supplies the top of the sheet of paper P picked up from the paper supply cassette 3*a* or 3*b* toward the first or second separation-conveying device 31*a* or 31*b*. The paper supply roller 61 is carried out to the paper supply roller shaft 61*c*, which is a fixed shaft driven in the direction of arrow g. As shown in FIG. 7, the separation roller shaft 60*c* is supported by a slit 103*a* formed in a frame 103 in the cassette mechanism 3 and can slide in the slit 103*a*. Therefore, the separation roller shaft 60*c*, although it slides in the slit 103*a*, is connected to the driving force via a link mechanism.

As shown in FIG. 6-2, a center of contact area of the separation roller 60 and the paper supply roller 61 will be defined if it is on the PC. In the positions at the same distance (lf=lr) from the centers of the separation roller 60, a pair of press levers 62*f* and 62*r* in an L shape, which is a pair of first and second pressure units in the same shape on the front side and rear side, is arranged respectively. The pair of press levers 62*f* and 62*r* is arranged possible rotation respectively around fulcrums 63*f* and 63*r*. An L-shaped free end 64*f* of the press lever 62*f* on the front side makes contact and applies load with the separation roller shaft 60*c* at a pressure unit 65*f* on the front side, and a free end 64*r* of the press lever 62*r* on the rear side makes contact and applies load with the separation roller shaft 60*c* at a pressure unit 65*r* on the rear side. And the two free ends of the press levers 62*f* and 62*r* press the separation roller shaft 60*c* in the direction of the arrow i, which is the direction toward the paper supply roller 61.

At hooks 66*f* and 66*r* formed on the pair of press levers 62*f* and 62*r*, one spring 67, which is an elastic member is bridged. The spring 67 stretches the hook 66*f* on the front side in the direction of the arrow j and the hook 66*r* on the rear side in the direction of the arrow k with the uniform force and gives the uniform press to the free ends 64*f* and 64*f* of the pair of press levers 62*f* and 62*r* in the direction of the arrow i.

To supply the sheet of paper P separated one by one in parallel toward the first or second conveying device 32*a* or 32*b*, the separation roller 60 and the paper supply roller 61 are arranged symmetrically on the basis of the PC. Further, the pair of press levers 62*f* and 62*r* on the front side and rear side is also arranged symmetrically on the basis of the PC. Furthermore, the pair of press levers 62*f* and 62*r* is attracted uniformly by one spring 67, so that the force pressurizing the separation roller shaft 60*c* by the pair of press levers 62*f* and 62*r* is equal on the rear side and front side. Therefore, the pressure of the pair of press levers 62*f* and 62*r* on the front side and rear side on the paper supply roller 61 of the separation roller becomes equal.

In the first or second separation-conveying device 31*a* or 31*b*, when separating the sheet of paper P picked up by the pickup rollers 30*a* or 30*b*, the separation rollers 60 is rotated in the direction of the arrow f so as to return the lower sheet of paper P toward the paper supply cassettes 3*a* or 3*b*. The separation roller 60 makes contact with the paper supply roller 61 by the pressure of the pair of press levers 62*f* and 62*r*. On the other hand paper supply roller 61 is rotated in the direction of the arrow g by driving by the paper supply roller shaft 61*c* by the paper supply motor, and supply only the top of the sheet of paper P toward the first or second conveying device 32*a* or 32*b*.

At this time, the paper supply roller 61, the separation roller 60, and the pair of press levers 62*f* and 62*r* are arranged symmetrically on the basis of the PC. Furthermore, by one spring 67, uniform tensile strength is given to the pair of press levers 62*f* and 62*r*. Therefore, the separation-conveying force of the sheet of paper P by the supply roller 61 and the separation roller 60 on the front side and the rear side become equal, and the sheet of paper P are not skewed, are kept straight, and reach the first or second conveying device 32*a* or 32*b*.

As mentioned above, during conveyance by the first or second separation-conveying device 31*a* or 31*b*, the sheet of paper P are not skewed, so that the dependence on repositioning of the sheet of paper P at the position of the aligning roller 33 is reduced, thus the aligning roller 33 can reposition the front ends of the sheet of paper P easily and surely. Hereafter, the sheet of paper P, in the same way as with the first embodiment aforementioned, are clamped and conveyed toward the aligning roller 33 by the first or second conveying device 32*a* or 32*b*.

In this embodiment structured like this, in the first or second separation-conveying device 31*a* or 31*b*, the paper supply roller 61, the separation roller 60, and the press roller pair 62*f* and 62*r* are arranged symmetrically on the basis of the PC and the tensile strength of the spring 67 applied between the press levers 62*f* and 62*r* is the same. From this, the separation-conveying force of the sheet of paper P by the paper supply roller 61 and the separation roller 60 on the front side and the rear side become equal.

Therefore, the sheet of paper P separated and conveyed by the first or second separation-conveying device 31*a* or 31*b* are not skewed by the first or second separation-conveying device 31*a* or 31*b* and the good conveying can be improved. Further, the dependence on repositioning skewing of the sheet of paper P by the aligning roller 33 can be reduced, and the sheet of paper P can be repositioned surely before image forming, thus an image forming apparatus free of image displacement and of high image quality is obtained.

Further, the present invention is not limited to the aforementioned embodiments and can be changed within a range, which is not deviated from the object of the present invention. For example, if the pressure unit can give uniformly the pressure between the fixing roller member and the load roller member, the shape and structure thereof are not restricted. Further, the number of the fixing roller member or the load roller member is not limited. Further, the elastic member is not limited to the spring and it may be rubber or a steel wire bridged between the pair of pressure units. Furthermore, the sheet-conveying device is not limited to the use location if it is a place requiring conveyance of sheet, that is, it may be used in the reversing path or for conveying sheet by the scanner, and is not limited to the copier.

As described above in detail, according to the present invention, the fixing roller member and the load roller member stably can clamp and convey sheet or can separate and convey sheet without skewing them. Therefore, conveying defects such as jamming and bending in the conveying path of sheet are prevented, and a sheet-conveying device of good conveying is obtained, and the dependence on repositioning skewing of the sheet by the aligning means can be reduced, and the sheet can be repositioned surely by the aligning roller, thus an image forming apparatus free of image displacement and of high image quality is obtained.

What is claimed is:

1. A sheet-conveying device, comprising:

a fixing roller member having a fixed shaft;

a load roller member pressing said fixing roller member and clamping sheet together with said fixing roller member;

a pair of first and second press levers that applies a load to said load roller member; and a spring bridged between said pair of press levers to provide a uniform elastic force to said pair of press levers and to uniform said load by said first and second press levers.

2. The sheet-conveying device according to claim 1, wherein said fixing roller member is a conveying roller driven to rotate in a conveying direction of said sheet, and said load roller member is a driven roller, which is driven by said conveying roller and convey said sheet in said conveying direction together with said conveying roller.

3. The sheet-conveying device according to claim 2, wherein said driven roller is attached to a load shaft such as to allow for free rotation of the driven roller, and said pair of press levers applies pressure to said load shaft towards said conveying roller.

4. The sheet-conveying device according to claim 2, wherein contact area of said conveying roller and said driven roller, and said pair of press levers are arranged symmetrically on the basis of a center of said sheet in said conveying direction.

5. The sheet-conveying device according to claim 2, wherein said conveying roller consists of independent plural rollers, which are arranged at said fixed shaft.

6. The sheet-conveying device according to claim 1, wherein said fixing roller member is a conveying roller driven to rotate in a conveying direction of said sheet, and said load roller member is a separation roller driven to rotate in a separating direction of said sheet.

7. The sheet-conveying device according to claim 6, wherein contact area of said conveying roller and said separation roller, and said pair of press levers are arranged symmetrically on the basis of a center of said sheet in said conveying direction.

8. An image forming apparatus, comprising:

an image carrier;

an image forming portion to form a toner image on said image carrier;

a paper supply unit to supply a sheet toward said image carrier;

a transfer unit to transfer said toner image on said image carrier to said sheet;

a fixing unit to fix said toner image on said sheet;

a paper discharge unit to support said sheet having said toner image;

a fixing roller member having a fixed shaft positioned between said paper supply unit and said paper discharge unit;

a load roller member pressing said fixing roller member and clamping sheet together with said fixing roller member;

a pair of first and second press levers that applies a load to said load roller member; and a spring bridged between said pair of press levers to provide a uniform elastic force to said pair of press levers and to uniform said load by said first and second press levers.

9. The image forming apparatus according to claim 8, wherein said fixing roller member is a conveying roller driven to rotate in a conveying direction of said sheet, and said load roller member is a driven roller, which is driven by said conveying roller and convey said sheet in said conveying direction together with said conveying roller.

10. The image forming apparatus according to claim 9, said driven roller is attached to a load shaft such as to allow for free rotation of the driven roller, and said pair of press levers applies pressure to said load shaft towards said conveying roller.

11. The image forming apparatus according to claim 9, wherein contact area of said conveying roller and said driven roller, and said pair of press levers are arranged symmetrically on the basis of a center of said sheet in said conveying direction.

12. The image forming apparatus according to claim 9, wherein said conveying roller consists of independent plural rollers, which are arranged at said fixed shaft.

13. The image forming apparatus according to claim 8, wherein said fixing roller member is a conveying roller driven to rotate in a conveying direction of said sheet, and said load roller member is a separation roller driven to rotate in a separating direction of said sheet.

14. The image forming apparatus according to claim 13, wherein contact area of said conveying roller and said separation roller, and said pair of press levers are arranged symmetrically on the basis of a center of said sheet in said conveying direction.

* * * * *